US009235180B2

(12) United States Patent
Ishigai et al.

(10) Patent No.: US 9,235,180 B2
(45) Date of Patent: Jan. 12, 2016

(54) IMAGE FORMING APPARATUS

(71) Applicant: KONICA MINOLTA, INC., Tokyo (JP)

(72) Inventors: Takuya Ishigai, Hino (JP); Naoki Yamamoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 14 days.

(21) Appl. No.: 13/658,455

(22) Filed: Oct. 23, 2012

(65) Prior Publication Data

US 2013/0101302 A1 Apr. 25, 2013

(30) Foreign Application Priority Data

Oct. 24, 2011 (JP) ..... 2011-233131

(51) Int. Cl.
*G03G 15/20* (2006.01)
*G03G 15/00* (2006.01)

(52) U.S. Cl.
CPC ..... *G03G 15/55* (2013.01); *G03G 15/2057* (2013.01)

(58) Field of Classification Search
CPC ..... G03G 15/235; G03G 15/2007; G03G 15/2014; G03G 15/5054; G03G 2125/00632
See application file for complete search history.

(56) References Cited

U.S. PATENT DOCUMENTS 4,937,633 A * 6/1990 Ewing ..... G03G 21/0023 15/256.5
5,900,295 A * 5/1999 Kawada ..... G03G 15/2057 399/333
6,222,158 B1 4/2001 Nakata et al.
7,623,818 B2 11/2009 Ohara et al.
8,483,603 B2 7/2013 Nihonyanagi et al.
2011/0116850 A1* 5/2011 Lee ..... H05B 3/0095 399/333

(Continued)

FOREIGN PATENT DOCUMENTS

JP 3-158878 7/1991
JP 6-202512 7/1994

(Continued)

OTHER PUBLICATIONS

JP_2007272223_A_H Machine Translation.*

(Continued)

*Primary Examiner* — Clayton E Laballe
*Assistant Examiner* — Victor Verbitsky
(74) *Attorney, Agent, or Firm* — Holtz, Holtz, Goodman & Chick PC

(57) ABSTRACT

A fixing device thermally fixes an unfixed toner image onto a recording sheet and includes: a rotatable heating element that is endless and includes a resistive heating layer that generates heat upon application of voltage; a power source for placing voltage across the resistive heating layer; an ammeter for measuring the electric current flowing through the resistive heating layer, and a controller for determining whether the resistive heating layer has a scratch by monitoring an amount of change between a value of electric current that flows through the resistive heating in absence of a scratch and a value of electric current actually measured by the ammeter. The resistive heating layer exhibits resistivity anisotropy satisfying R1<R2, where R1 and R2 denote a volume resistivity of the resistive heating layer in a direction of voltage application and that in a direction perpendicular to the direction of voltage application, respectively.

10 Claims, 13 Drawing Sheets

(56) References Cited

U.S. PATENT DOCUMENTS

| | | | |
|---|---|---|---|
| 2011/0222894 | A1 | 9/2011 | Yamamoto et al. |
| 2011/0229162 | A1 | 9/2011 | Ogawa et al. |

FOREIGN PATENT DOCUMENTS

| | | | |
|---|---|---|---|
| JP | 10-20708 | | 1/1998 |
| JP | 11064294 | A | 3/1999 |
| JP | 2001175102 | A | 6/2001 |
| JP | 2007-272223 | | 10/2007 |
| JP | 2007286407 | A | 11/2007 |
| JP | 2009-109997 | | 5/2009 |
| JP | 2009204745 | A | 9/2009 |
| JP | 2011145656 | A | 7/2011 |
| JP | 2011-186356 | | 9/2011 |
| JP | 2011-197060 | | 10/2011 |
| JP | 2013083870 | A | 5/2013 |
| WO | 2009028022 | A1 | 3/2009 |

OTHER PUBLICATIONS

Notification of Reasons for Refusal mailed Oct. 1, 2013, directed to JP Application No. 2011-233131; 4 pages.

Japanese Decision to Grant a Patent dated May 20, 2014 issued in counterpart Japanese Application No. 2011-233131.

* cited by examiner

IMAGE FORMING APPARATUS

CROSS-REFERENCE TO RELATED APPLICATIONS

This application is based on application No. 2011-233131 filed in Japan, the contents of which are hereby incorporated by reference.

BACKGROUND OF THE INVENTION (1) Field of the Invention

The present invention relates to fixing devices installed in an image forming apparatus, such as a printer or a copier, and in particular to a technique of detecting abnormal heating in a fixing device having a resistive heating layer as a heating element.

(2) Description of the Related Art

In recent years, more and more image forming apparatuses, such as printers and copiers, employ a fixing device having, as a heating element, a resistive heating layer that generates heat by Joule heating upon passage of current. In such a fixing device, the heating element generates heat by feeding power directly to the resistive heating layer, which is effective to improve the heat utilization efficiency and to shorten the warm-up time.

The resistive heating layer is formed from insulating material, such as heat-resistant resin, and conductive material, such as metal, dispersed in the insulating material. In addition, since direct contact with the resistive heating layer may cause an electric shock, it is common to coat the resistive heating layer with an insulating layer. For example, JP patent application publication No. 2009-109997 discloses a fixing device having, as a heating element, a resistive heating layer coated with an insulating layer.

However, a typical insulating layer is as thin as the order of a few hundreds of micrometers and therefore vulnerable to scratches by contact with a foreign object or a recording sheet. If a scratch is deep enough to reach the resistive heating layer and extends in a direction not parallel to the current flow direction (especially in the direction perpendicular to the current flow direction), the current tends to collect intensively at locations around the ends of the scratch as a result of bypassing the scratch. Consequently, the current density becomes locally high at such locations of the resistive heating layer, which in turn causes heat generation to abnormally high temperatures at such locations.

Since leaving such abnormal heating may result in damaging the fixing device, it is necessary to accurately detect occurrence of abnormal heating to timely take an appropriate measure, such as shutting off the power supply to the fixing device, to avoid or minimize damage to the fixing device.

The fixing device is equipped with a temperature sensor, such as a thermistor or a thermostat. Therefore, occurrence of abnormal heating in the resistive heating layer is detected by the temperature sensor, so that a necessary measure can be taken to prevent damage to the fixing device.

Unfortunately, however, the temperature sensor, such as a thermistor or thermostat, installed in the fixing device typically has a narrow sensing range and may not be able to detect occurrence of abnormal heating, depending on the location in the resistive heating layer where abnormal heating takes place.

One method to solve the above problem is to monitor the current flowing through the resistive heating layer to detect occurrence of abnormal heating from a change in the value of an electric current between the normal operation time and the time of abnormal heating. While this method solves the above problem as the entire resistive heating layer is included in the sensing range, the amount of change in the electric current is usually small. This method is therefore susceptible to measurement errors associated with the current detection circuit and presents another problem of high probability of false-positive and false-negative results in detection of abnormal heating.

SUMMARY OF THE INVENTION

In order to achieve the above aim, one aspect of the present invention provides a fixing device for thermally fixing an unfixed toner image onto a recording sheet. The fixing device includes: a heating belt that is endless and includes a resistive heating layer configured to generate heat to fuse the unfixed image on the recording sheet; an electrifier that applies voltage across the resistive heating layer; a detector that measures a value of electric current flowing through the resistive heating layer; and a determiner that determines whether or not the resistive heating layer has a scratch by monitoring an amount of change between a reference value predetermined for an electric current flowing through the resistive heating layer having no scratch and an actual value of the electric current measured by the detector. The resistive heating layer exhibits resistivity anisotropy satisfying $R1<R2$, where R1 denotes a volume resistivity of the resistive heating layer in a direction of voltage application, and R2 denotes a volume resistivity of the resistive heating layer in a direction perpendicular to the direction of voltage application.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENTS

The following describes an embodiment of an image forming apparatus according to the present invention, by way of a tandem-type digital color printer (hereinafter, simply "printer").

[1] Structure of Printer

Figure 1:
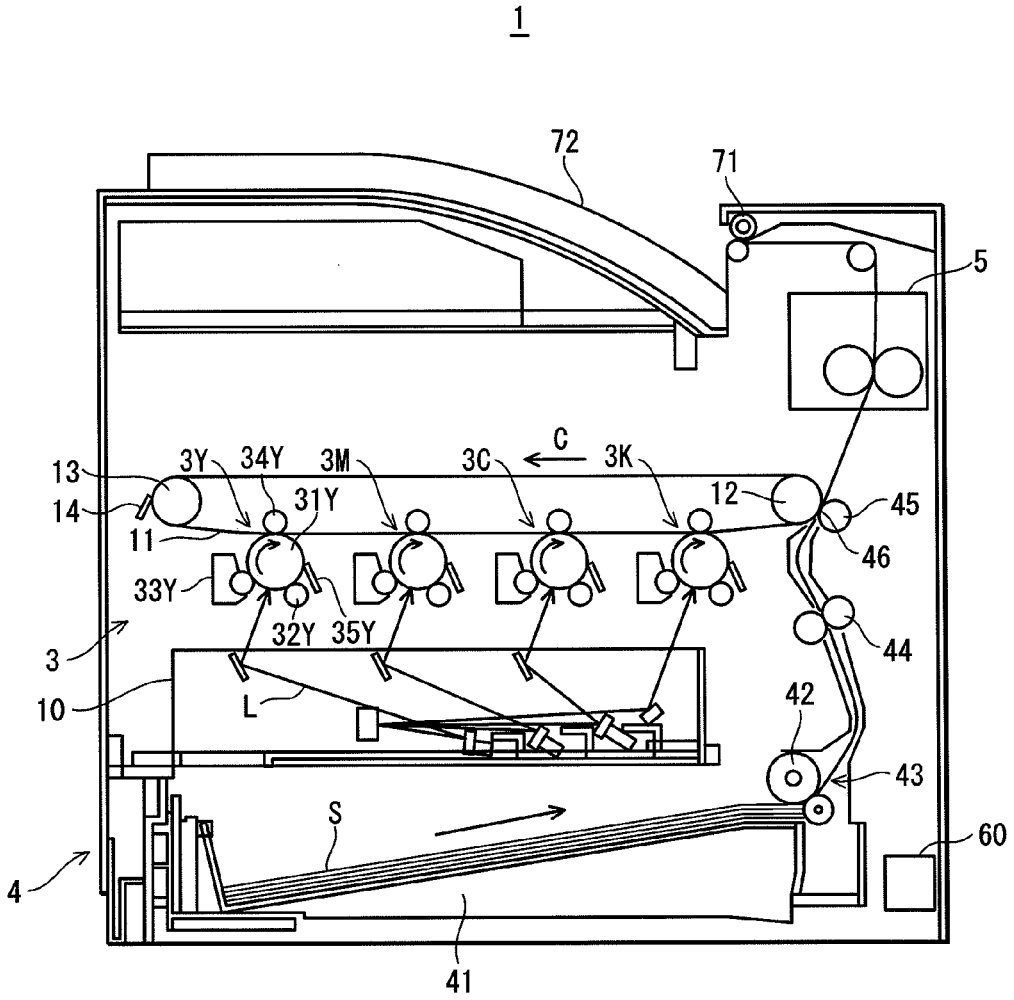
FIG. 1 is a view showing the structure of a printer 1.

First, the structure of a printer 1 according to this embodiment is described. FIG. 1 is a view showing the structure of the printer 1. As shown in the figure, the printer 1 includes an image processer 3, a sheet feeder 4, a fixing device 5, and a controller 60.

The printer 1 is connected to a network (such as LAN) to receive requests for executing a print job from an external terminal device (not illustrated) or from a non-illustrated operation panel. Upon receipt of such a request, the printer 1 forms toner images of the respective colors of yellow, magenta, cyan, and black, and sequentially transfers the toner images to form a full-color image, thereby completing printing on a recording sheet.

In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

The image processer 3 includes image creating units 3Y, 3M, 3C, and 3K, an exposure unit 10, an intermediate transfer belt 11, a second transfer roller 45, and so on.

The image creating units 3Y, 3M, 3C, and 3K all have identical structures. Therefore, the following description is given mainly to the structure of the image creating unit 3Y.

The image creating unit 3Y includes a photoconductive drum 31Y and also includes a charger 32Y, a developer 33Y, a first transfer roller 34Y, a cleaner 35Y, and so on, which are disposed about the photoconductive drum 31Y. The cleaner 35Y is provided for cleaning the photoconductive drum 31Y. The image creating unit 3Y forms a yellow toner image on the photoconductive drum 31Y. The developer 33Y is disposed to face the photoconductive drum 31Y and carries charged toner particles to the photoconductive drum 31Y.

The intermediate transfer belt 11 is an endless belt wound around a drive roller 12 and a passive roller 13 in taut condition to run in the direction indicated by the arrow C. In the vicinity of the passive roller 13, a cleaner 14 is disposed to remove residual toner from the intermediate transfer belt. The exposure unit 10 includes a light emitting element, such as a laser diode. In accordance with drive signals from the controller 60, the exposure unit 10 emits a laser beam L to sequentially scan the surfaces of the photoconductive drums of the image creating units 3Y, 3M, 3C, and 3K to form images of the respective colors Y, M, C, and K.

As a result of the exposure scan, an electrostatic latent image is developed on the surface of the photoconductive drum 31Y charged by the charger 32Y. In a similar manner, an electrostatic latent image is formed on the surface of the photoconductive drum in each of the image creating units 3M, 3C, and 3K. The electrostatic latent image formed on each photoconductive drum is developed by the developer of a corresponding one of the image creating units 3Y, 3M, 3C, and 3K, so that a toner image of a corresponding color is formed on the photoconductive drum.

The toner images thus formed are sequentially transferred with appropriately adjusted timing by the first transfer rollers of the image creating unit 3Y, 3M, 3C, and 3K (in FIG. 1, only the first transfer roller of the image creating unit 3Y bears the reference sign 34Y, whereas the reference signs of the other first transfer rollers are omitted) in the process of first transfer, so that the toner images are layered at the precisely same position on the surface of the intermediate transfer belt 11. Then, in the process of second transfer, the toner images layered on the intermediate transfer belt 11 are transferred all at once onto a recording sheet by the action of the electrostatic force imposed by the second transfer roller 45. The recording sheet having the toner images transferred thereon is further carried to the fixing device 5 where the unfixed tonner images on the recording sheet is heated and pressed to be thermally fixed. The recording sheet is then ejected by a pair of ejecting rollers 71 onto an exit tray 72.

The sheet feeder 4 includes a paper feed cassette 41 for storing recording sheets (denoted by a reference sign S in FIG. 1), a pickup roller 42 that picks up recording sheets from the paper feed cassette 41 one sheet at a time and feeds the recording sheet onto a conveyance path 43, and a pair of timing rollers 44 that adjusts the timing to transport the fed recording sheet to a second transfer position 46. Note that the number of paper feed cassettes is not limited to one, and a plurality of paper feed cassettes may be provided.

Examples of recording sheets include sheets of paper differing in size and thickness (plain paper and thick paper) and film sheets such as OHP film sheets. In the case where a plurality of paper feed cassettes are provided, each cassette may be used to store recording sheets of a specific size, thickness, or material.

Each roller including the pickup roller 42 and the pair of timing rollers 44 is powered by a transfer motor (not illustrated) and driven to rotate via power transmission mechanisms, such as gears and belts (not illustrated). Examples of the transfer motor include a stepping motor capable of controlling the rotation speed with high precision.

A recording sheet is conveyed from the sheet feeder 4 to the second transfer position 46 in a timed manner with the position of the toner images on the move on the intermediate transfer belt 11. At the second transfer position 46, the toner images layered on the intermediate transfer belt 11 are transferred to the recording sheet at once by the second transfer roller 45.

[2] Structure of Fixing Device

Figure 2A:
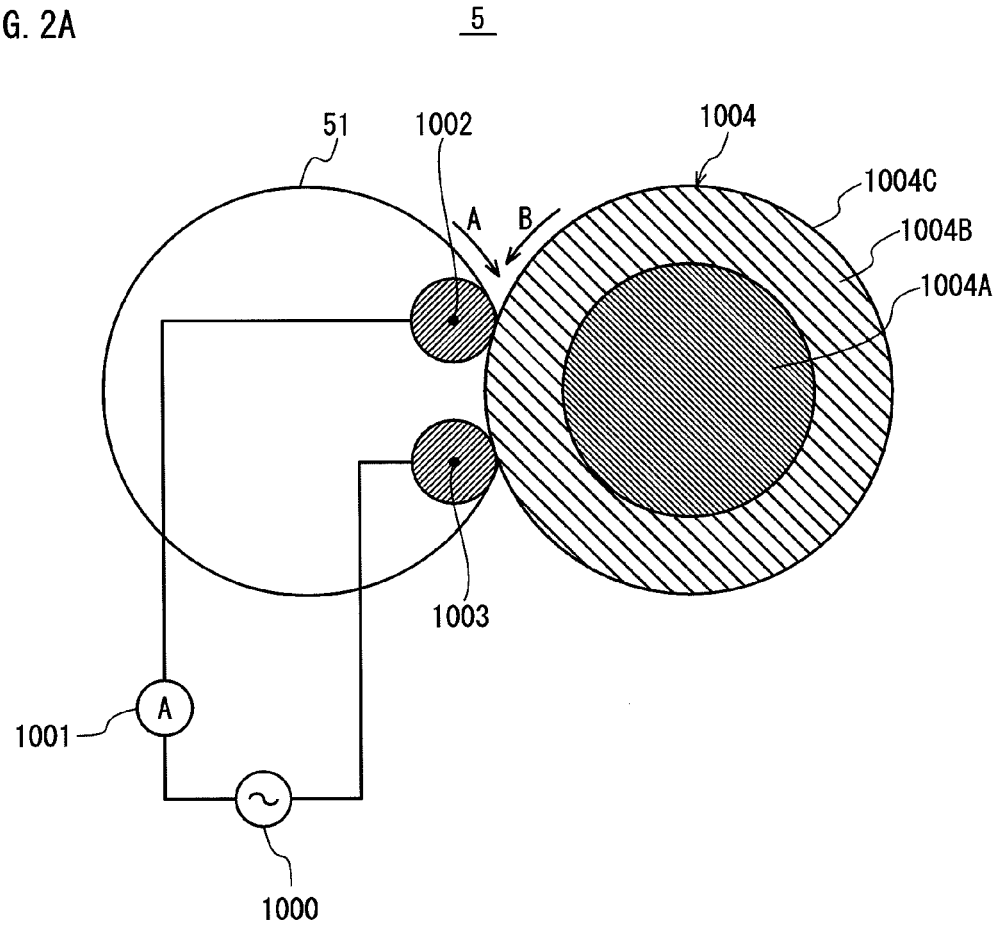
FIGS. 2A and 2B are cross sectional views each showing the structure of a fixing device 5.

FIG. 2A is a cross sectional view showing the structure of the fixing device 5. As shown in the figure, the fixing device 5 includes a rotatable heating element 51, a pair of power feed rollers 1002 and 1003, a pressing roller 1004, a power source 1000 for placing voltage across the power feed rollers 1002 and 1003 to pass electric current, an ammeter 1001 for measuring the electric current flowing through the rotatable heating element 51 (a resistive heating layer 513, which will be described later), a fixing element (not illustrated) disposed in contact with the inner circumferential surface of the rotatable heating element 51 at a location between the power feed rollers 1002 and 1003, and so on. The fixing element forms a fixing nip with the pressing roller 1004.

Figure 2B:
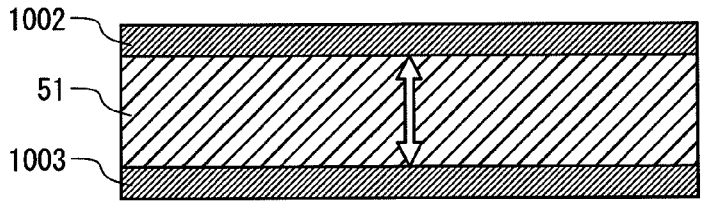

The rotatable heating element 51 is an endless belt elongated in the axial direction and includes the later-described resistive heating layer 513 to which voltage is applied in the circumferential direction from the power source 1000 via the power feed rollers 1002 and 1003 each of which is also elongated in the axial direction. Consequently, the current passes between the power feed rollers 1002 and 1003 in the circumferential direction as indicated by an open arrow shown in FIG. 2B.

In addition, a non-illustrated temperature sensor is disposed at a predetermined location near the outer circumferential surface of the rotatable heating element 51 (in this example, at a location near the central portion in the lengthwise direction). The temperature sensor measures the temperature of the outer circumferential surface of the rotatable heating element 51. Depending on the temperature measured by the temperature sensor, the controller 60 controls the power feed from the power source 1000 to the later-described resistive heating layer 513 of the rotatable heating element 51 so as to regulate the temperature of the outer surface of the rotatable heating element 51 to an appropriate fixing temperature (150° C., for example).

Figure 3:
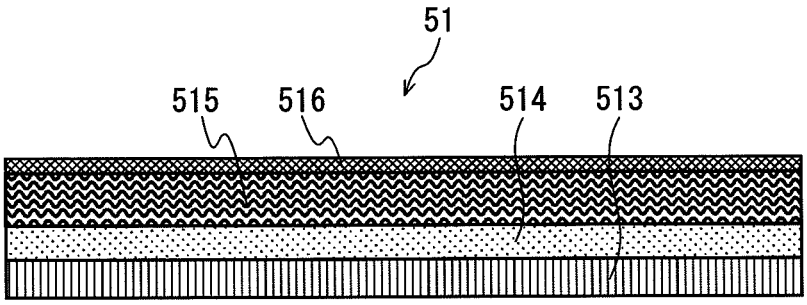
FIG. 3 is a cross sectional view showing the detailed structure of a rotatable heating element 51.

FIG. 3 is a cross sectional view showing the detailed structure of the rotatable heating element 51. As shown in the figure, the rotatable heating element 51 includes the resistive heating layer 513, a reinforcing layer 514, an elastic layer 515, and a releasing layer 516 that are laminated in the stated order.

The resistive heating layer 513 generates heat by Joule heating upon receipt of power feed from the power source 1000 via the power feed rollers 1002 and 1003. The resistive heating layer 513 is made from a heat-resistant resin and fibrous, acicular, or flaked conductive filler particles that are dispersed on or in the heat-resistant resin in a manner that the conductive filler particles are oriented in the circumferential direction (i.e., voltage application direction).

Figure 4A:
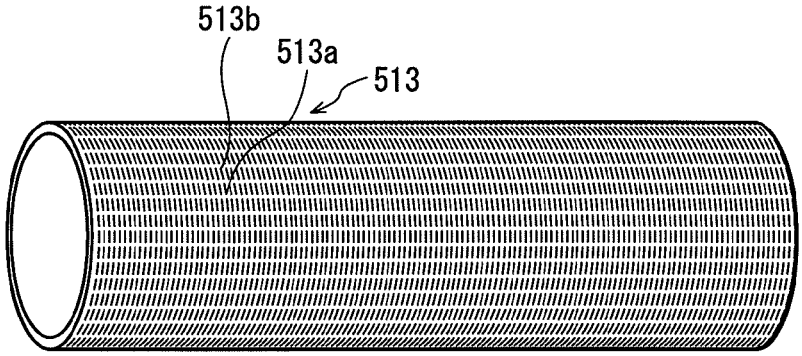
FIG. 4A is a view conceptually showing the minute structure of a resistive heating layer 513.
Figure 4B:
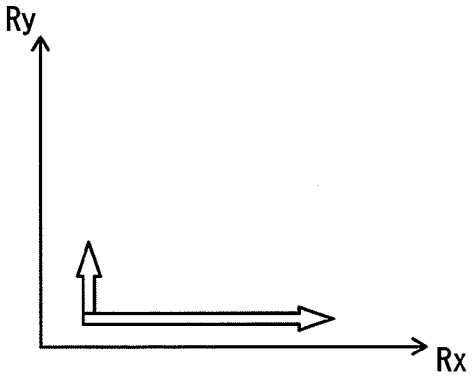
FIG. 4B is a plot conceptually showing resistivity anisotropy of the resistive heating layer 513.

FIG. 4A is a view conceptually showing the minute structure of the resistive heating layer 513. In FIG. 4A, the reference sign 513 denotes the resistive heating layer, 513*a* denotes the conductive filler particles, and 513*b* denotes the heat-resistant resin. As shown in FIG. 4A, the conductive filler particles 513*a* are disposed to be oriented in the circumferential direction (voltage application direction). With this arrangement, the resistive heating layer 513 is more conductive in the circumferential direction (voltage application direction) than in the lengthwise direction (the direction perpendicular to the voltage application direction). Therefore, as indicated by open arrows in FIG. 4B, the resistive heating layer 513 exhibits resistivity anisotropy between the voltage application direction and the direction perpendicular to the voltage application direction (i.e., between the Ry direction and the Rx direction). More specifically, the electrical resistance (volume resistivity) is larger in the Ry direction (i.e., in the voltage application direction) than in the Rx direction (i.e., in the direction perpendicular to the voltage application direction).

As a result, even if a scratch is caused in the resistive heating layer 513 and a lengthwise direction of the scratch is perpendicular to the voltage application direction, the current flow occurring in the direction perpendicular to the voltage application direction to bypass the scratch is suppressed, as compared with that occurs in a resistive heating layer without resistivity anisotropy. Therefore, the value of electric current flowing in the presence of such a scratch is lowered, which naturally increases the amount of change (the reduction in the electric current value) between the current flowing in the presence of a scratch and the current flowing in the absence of any scratch.

The ratio of volume resistivity between the voltage application direction and the direction perpendicular to the voltage application direction is adjustable by adjusting the density of conductive filler particles oriented in the voltage application direction or by adjusting the intervals of conductive filler particles in the direction perpendicular to the voltage application direction. That is, the resistive heating layer 513 having the desired volume resistivity ratio is duly obtained and the volume resistivity ratio is duly adjustable to a predetermined ratio.

Examples of a heat-resistant resin usable to form the resistive heating layer 513 include a polyimide resin, a polyethylene sulfide resin, a polyether ether ketone resin, a polyaramid resin, a polysulfone resin, a polyimideamide resin, a polyester-imide resin, a polyphenyleneoxide resin, a poly-p-xylylene resin, and a polybenzimidazole resin. Among these resins, a polyimide resin is preferable because of its advantageous properties including heat resistance, insulating property, and mechanical strength.

Examples of suitable conductive filler include metals such as silver (Ag), cupper (Cu), aluminum (Al), magnesium (Mg), and nickel (Ni) as well as carbon nanotube, carbon nanofiber, and carbon nanocoil. In addition, two or more different types of conductive fillers (for example, carbon nanotube material and metal) may be used in combination.

As for the shape of conductive filler particles, fibrous, acicular, or flaked form is preferable because such conductive filler particles tend to make more contact through liner entanglement and thus increases the probability of contact between individual filler particles without increasing the total volume of filler. With the above arrangement, the resistive heating layer 513 having a uniform electrical resistance is molded.

Although the thickness of the resistive heating layer 513 may be decided arbitrarily, the thickness within the range of 5 to 100 μm or so is preferable. The volume resistivity of the resistive heating layer 513 may be set to fall within the range of $1.0\times10^{-6}$ to $1.0\times10^{-2}$ Ωm or so. Yet, the preferable volume resistivity falls within the range of $1.0\times10^{-5}$ to $5.0\times10^{-3}$ Ωm.

With reference again to FIG. 3, the reinforcing layer 514 is to provide additional stiffness to the resistive heating layer 513. For example, a polyimide resin may be used for the reinforcing layer 514. Although the thickness of the reinforcing layer 514 may be decided arbitrarily, the thickness within the range of 5 to 100 μm or so is preferable. The elastic layer 515 is to conduct heat to toner images on the recording sheet evenly with flexibility. The provision of the elastic layer 515 prevents toner images from being pressed to be smudged or fused unevenly and thus serves to prevent image noise. The elastic layer 515 may be made from a heat-resistant and elastic material, such as rubber or resin. A heat-resistant elastomer, such as silicone rubber or fluorine-containing rubber, is a suitable example.

The thickness of the elastic layer 515 falls within the range of 10 to 800 μm, and more preferably within the range of 50 to 300 μm. With the thickness of less than 10 μm, the elastic layer 515 may not be able to ensure sufficient elastic properties in the thickness direction. Yet, the thickness exceeding 800 μm is not preferable either because the resistive heating layer 513 having such a thickness may not sufficiently conduct heat to the outer circumferential surface of the rotatable heating element 51, leading to reduction in the heat transfer efficiency.

The releasing layer 516 constitutes the outermost layer of the rotatable heating element 51 and improves the properties of ensuring a recording sheet to be released easily from the rotatable heating element 51. The releasing layer 516 is made from a material having resistance at the fixing temperature and excellent properties of releasing toner. Example of materials usable for the releasing layer 516 include fluororesin such as PFA (tetrafluoroethylene perfluoroalkoxy vinyl ether copolymer), PTFE (polytetrafluoroethylene), FEP (polytetrafluoroethylene-ethylene hexafluoride copolymer), and PFEP (polytetrafluoroethylene-propylene hexafluoride copolymer). The thickness of releasing layer 516 falls within the range of 5 to 100 μm and preferably within the range of 10 to 50 μm.

Referring back to FIG. 2, the pressing roller 1004 has a cored bar 1004A that is rotatably mounted at both ends on a pair of bearings (not illustrated) secured on a non-illustrated frame. The pressing roller 1004 is driven to rotate in the direction indicated by the arrow B upon receipt of power from a drive motor (not illustrated). Along with the rotation of the pressing roller 1004, the rotatable heating element 51 passively rotates in the direction of arrow A.

The pressing roller 1004 includes a cored bar 1004A having an elongated cylindrical shape and an elastic layer 1004B and a releasing layer 1004C that are layered around the cored bar 1004A in the stated order. The pressing roller 1004 is disposed at a location outside the running path of the rotatable heating element 51 to press the outer surface of the rotatable heating element 51 inwardly toward the non-illustrated fixing element. As a result, the fixing nip having a predetermined length in the circumferential direction is formed between the rotatable heating element 51 and the pressing roller 1004.

The cored bar 1004A supports the pressing roller 1004 and is composed of a material having heat resistance and strength. Example materials usable for the cored bar 1004A include aluminum, iron, and stainless. The elastic layer 1004B is an elastic body such as silicone rubber or fluorine-containing rubber and formed of a heat-resistant material to have a thickness falling in the range of 1 to 20 mm. Similarly to the releasing layer 516, the releasing layer 1004C improves the properties of ensuring a recording sheet to be released easily from the pressing roller 1004. The releasing layer 1004C may be identical to the releasing layer 516 in terms of its material and thickness.

[3] Structure of Controller

Figure 5:
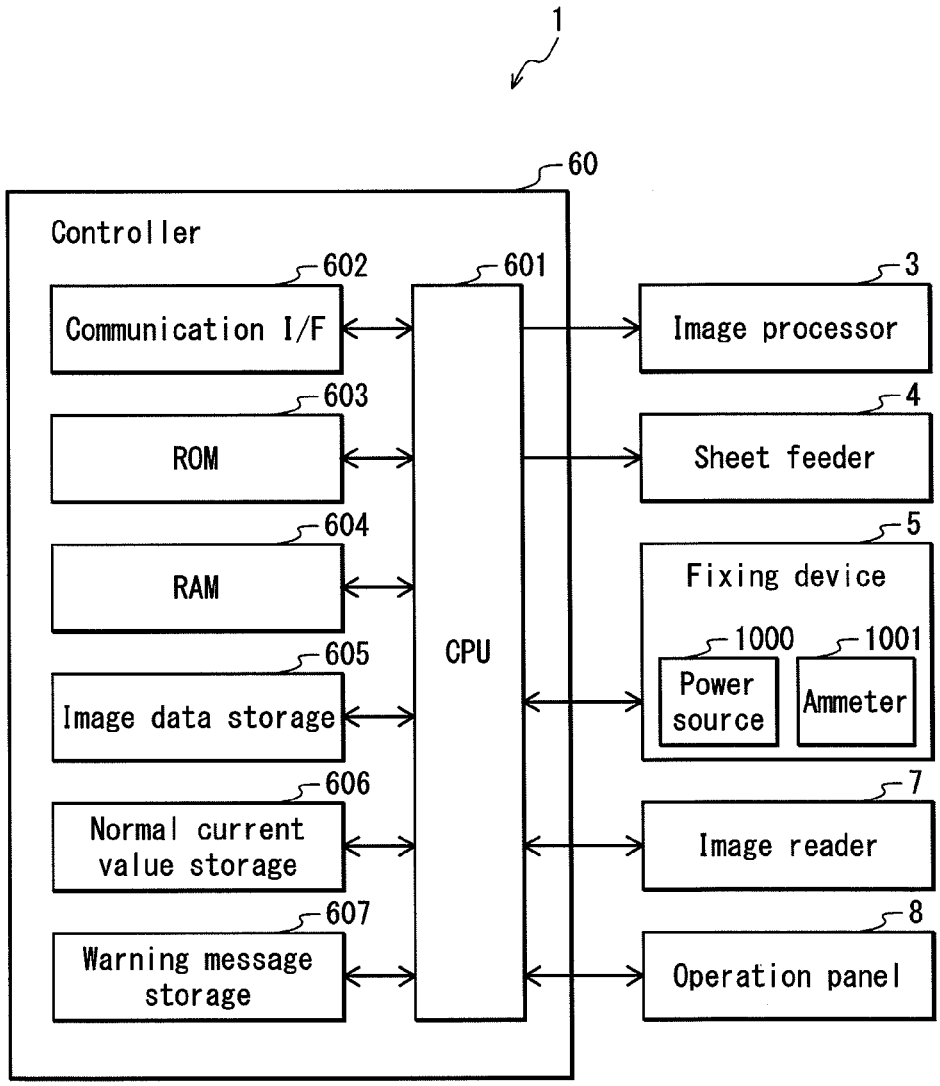
FIG. 5 is a block diagram showing the structure of a controller 60, along with the relation with major components controlled by the controller 60.

FIG. 5 is a block diagram showing the structure of the controller 60, along with the relation with major components controlled by the controller 60. The controller 60 is a so-called computer. As shown in the figure, the controller 60 includes a CPU (Central Processing Unit) 601, a communication interface (I/F) 602, ROM (Read Only Memory) 603, RAM (Random Access Memory) 604, an image data storage 605, a normal current value storage 606, and a warning message storage 607.

The communication I/F 602 is an interface for connection to a LAN through a LAN card or LAN board. The ROM 603 stores programs used for controlling the image processer 3, the sheet feeder 4, the components of the fixing device 5, such as the power source 1000 and the ammeter 1001, an image reader 7, and an operation panel 8. The ROM 603 also stores programs used for executing the warm-up time abnormal heating detection and the print job time abnormal heating detection, both of which will be described later.

The RAM 604 is used by the CPU 601 as a work area at the time of program execution.

The image data storage 605 stores image data for printing. The stored image data is input via the communication I/F 602 or the image reader 7. The normal current value storage 606 stores the normal current value ($I_0$) and the abnormal heating reference value. Here, the term "normal current value" refers to the value of electric current flowing through the resistive heating layer 513 without any scratch. More specifically, it refers to the value of electric current flowing through the resistive heating layer 513 when the outer circumferential surface of the rotatable heating element 51 reaches the fixing temperature (150° C., for example) (i.e., at the completion of warm-up or at the execution of a print job).

On the other hand, the term "abnormal heating reference value" refers to the value indicating the predetermined amount of change from the normal current value. In the abnormal heating detection performed at the warm-up time or at the time of executing a print job time, the abnormal heating reference value is used as the criterion for determining whether a scratch has occurred in the resistive heating layer 513 to cause abnormal heating.

More specifically, the abnormal heating reference value is defined to be the amount of change between the normal current value and the value of the electric current flowing through the resistive heating layer 513 upon completion of warm-up provided that the resistive heating layer 513 has a scratch running lengthwise of the resistive heating layer 513 to account for 30% of the entire length of the resistive heating layer 513 in the lengthwise direction. The amount of change is calculated by solving the following equation for α:

$$\alpha=\{(I_0-I)/I_0\}\times 100.$$

The amount of change is calculated by making the following substitutions to the above equation, where $I_0$ represents the normal current value, and I represents the value of electric current flowing though the resistive heating layer 513 having a scratch running lengthwise of the resistive heating layer 513 to account for 30% of the entire length of the resistive heating layer 513.

The warning message storage 607 stores data used for displaying a warning message on the operation panel 8 upon detection of abnormal heating in the resistive heating layer 513 as a result of the warm-up time or print job time abnormal heating detection. More specifically, the warning message storage 607 stores data for displaying a message informing that abnormal heating is taking place.

The CPU 601 executes various programs stored on the ROM 603 to control the image processer 3, the sheet feeder 4, the components of the fixing device 5, such as the power source 1000 and the ammeter 1001, the image reader 7, the operation panel 8, and the like, and also to control the warm-up time abnormal heating detection and the print job time abnormal heating detection, which will be described later.

The image reader 7 is composed of an image input device, such as a scanner, and reads text and graphics printed on a recording sheet, such as a sheet of paper, to form image data.

The operation panel 6 is provided with a plurality of input keys and a liquid crystal display overlaid with a touch panel. In response to a touch operation on the touch panel or to a key operation on an input key, the operation panel 6 passes a corresponding user instruction to the controller 60.

[4] Manufacturing Method of Rotatable Heating Element (1) Process of Applying Precursor of Resistive Heating Layer 513

Conductive filler is mixed into a polyimide precursor solution to prepare the polyimide precursor solution in which the conductive filler particles are dispersed, and the thus prepared precursor solution is applied to the outer circumferential surface of a cylindrical metal mold through a nozzle. The application of the polyimide precursor solution is done by scanning (or moving) the nozzle around the outer cylindrical surface of the metal mold in the circumferential direction, so that the conductive filler particles dispersed in the polyimide precursor solution are applied on the circumferential surface in the state all oriented in the circumferential direction. Then, the cylindrical metal mold is repeatedly shifted in the axial direction by a predetermined distance to carry out another scanning of the nozzle in the circumferential direction to apply the conductive filler in the circumferential direction in the above-described manner.

After the application process, the applied polyimide precursor solution is brought into a semi-cured state. The polyimide precursor solution is brought into a semi-cured state by, for example, heating the metal mold in an oven at about 100° C. for about an hour.

The conductive filler dispersed in the polyimide precursor solution is adjusted to constitute 50% to 300% by weight of the solids contents of the polyimide precursor in the solution. With the above arrangement, the volume resistivity of the resistive heating layer 513 is adjusted to cause the amount of heat generated by the fixing device 5 to fall in the range of 500 to 1500 W.

In addition, by adjusting the density of the conductive filler applied in the circumferential direction or the distance to be moved per shift in the axial direction, the resistive heating layer 513 is ensured to have a desired ratio of the volume resistivity between the circumferential direction (i.e., the voltage application direction) and the axial direction of the cylinder (i.e., the direction perpendicular to the voltage application direction).

(2) Process of Applying Precursor of Reinforcing Layer 514

A polyimide precursor solution is applied as the precursor of the reinforcing layer 514 onto the outer circumferential surface of the cylindrical metal mold to which the conductive filler has been applied.

(3) Process of Forming Reinforcing Layer 514

The thus applied precursor of the reinforcing layer 514 is heated to a semi-cured state in a manner similar to the process (1) above, so that forming of the precursor is done.

(4) Process of Polyimide Precursor Imidization

The formed polyimide precursor is heated to complete imidization the polyimide precursor. More specifically, the polyimide precursor is heated for one hour at about 350° C., for example. As a result of the heating, imidization of the two layers is completed substantially at the same time, so that the resistive heating layer 513 and the reinforcing layer 514 are formed in a manner to improve the bonding between the two layers.

(5) Process of Applying Precursor of Elastic Layer 515

First, a primer is applied and dried on the outer surface of the reinforcing layer 514, and then a silicone rubber precursor solution is applied on the primer. As the primer, XP81-405 manufactured by Momentive Performance Materials Inc. may be used, for example.

As the silicone rubber precursor solution, XP81-A6361 also manufactured by Momentive Performance Materials Inc. may be used, for example.

(6) Process of Forming Elastic Layer 515

The applied silicone rubber precursor solution is heated to carry out primary vulcanization, so that the elastic layer 515 is formed. The primary vulcanization is carried out by heating the silicone rubber precursor solution in an oven at about 150° C. for ten minutes or so.

(7) Process of Coating Elastic Layer 515 with Releasing Layer 516

To improve the bonding with the elastic layer 515, an addition-type liquid silicone rubber is applied, as silicone rubber precursor, to the inner surface of the releasing layer 516, and then the releasing layer 516 is applied to coat the elastic layer 515. As the addition-type silicone rubber, XE15-B7354-40Kx2S also manufactured by Momentive Performance Materials Inc. may be used, for example. As the releasing layer 516, PFA tubing may be used, for example.

(8) Process of Bonding

The silicone rubber precursor applied between the elastic layer 515 and the releasing layer 516 is heated to carry out secondary vulcanization, thereby bonding the two layers together. The secondary vulcanization is carried out by heating the silicone rubber precursor in an oven at about 200° C. for four hours or so. Through the above processes, the rotatable heating element 51 is formed.

[5] Abnormal Heating Detection

Figure 6:
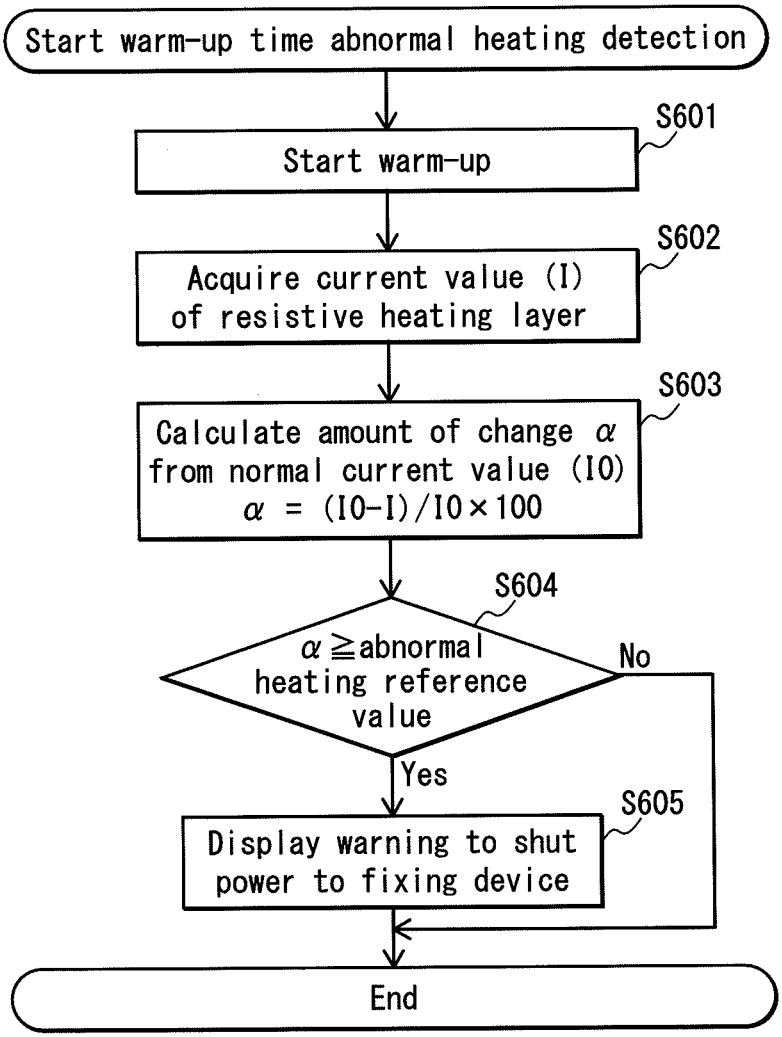
FIG. 6 is a flowchart showing the operation of abnormal heating detection performed by the controller 60 at the warm-up time.

FIG. 6 is a flowchart showing the operation of abnormal heating detection performed by the controller 60 at the warm-up time. At the time when the printer 1 is powered ON or when a print job is requested by a user via the operation panel 8 or the communication I/F 602 in the state where the power supply to the fixing device 5 has been suspended (sleep state), the controller 60 causes the power to be fed to the rotatable heating element 51 from the power source to start warm-up of the fixing device 5 (step S601).

Then, the controller 60 monitors the temperature measured by the temperature sensor located in the vicinity of the outer circumferential surface of the rotatable heating element 51. On detecting that the measured temperature reaches the fixing temperature (150° C., for example), the controller 60 acquires from the ammeter 1001 the current value (I) indicating the value of the electric current flowing through the resistive heating layer 513 (step S602) to control ON/OFF of the power feed to the power source 1000 to maintain the temperature of the outer circumferential surface of the rotatable heating element 51 at the fixing temperature.

Next, the controller 60 acquires the normal current value ($I_0$) stored in the normal current value storage 606, calculates the amount of change $\alpha$ based on the acquired $I_0$ and I ($\alpha=\{(I_0-I)/I_0\}\times100$) (step S603), and determines whether the thus calculated value of a is equal to or greater than the abnormal heating reference value stored in the normal current value storage 606 (step S604).

If the value of a is equal to the abnormal heating reference value or greater (step S604: YES), the controller 60 determines that abnormal heating has occurred in the resistive heating layer 513 and thus stops the power feed to the power source 1000 of the fixing device 5 and displays a warning message indicating occurrence of the abnormal heating on the liquid crystal display of the operation panel 8 based on the data stored in the warning message storage 607 (step S605).

Figure 7:
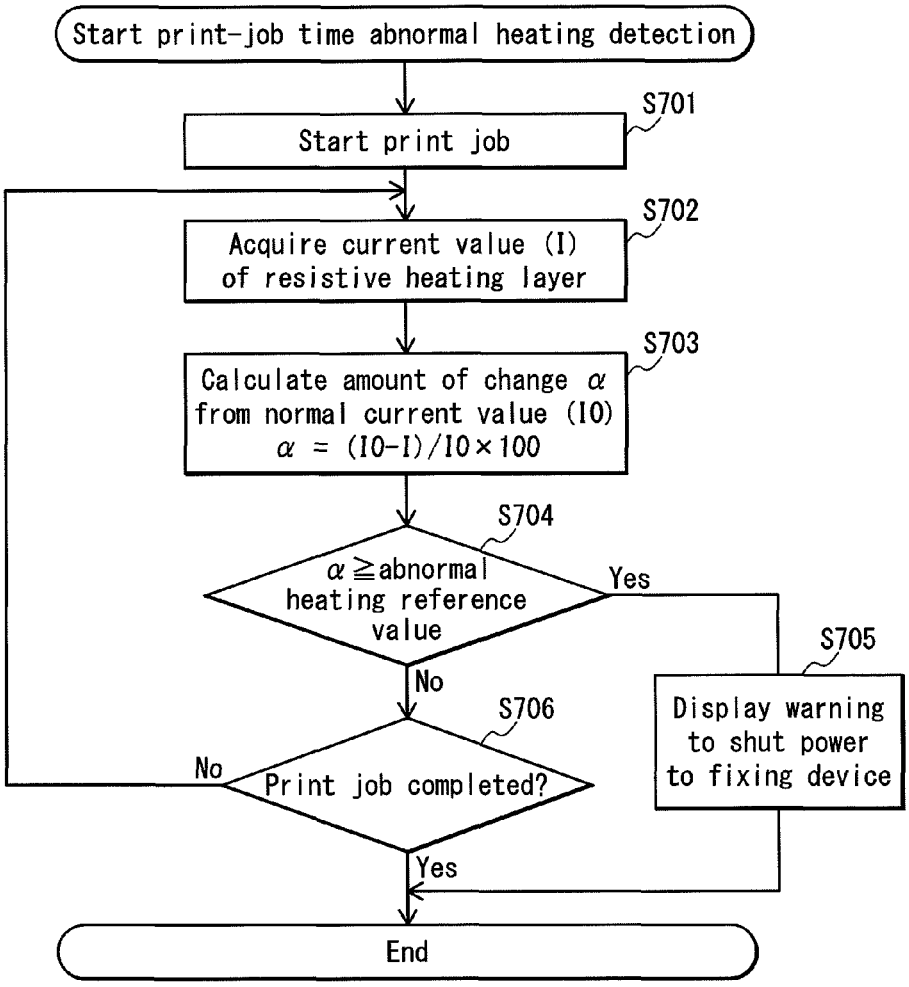
FIG. 7 is a flowchart showing the operation of abnormal heating detection performed by the controller 60 at the time of print job execution.

FIG. 7 is a flowchart showing the operation of abnormal heating detection performed by the controller 60 at the time of print job execution. In the case where a print job request has been received from a user via the operation panel 8 or the communication I/F 602 and the warm-up of the fixing device 5 has been completed (i.e., the temperature of the outer circumferential surface of the rotatable heating element 51 has already reached the fixing temperature), the controller 60 starts the print job (step S701), acquires from the ammeter 1001 the current value (I) indicating the value of the electric current flowing through the resistive heating layer 513 (step S702), acquires the normal current value ($I_0$) from the normal current value storage 606, calculates the amount of change $\alpha$ from the normal current value based on the acquired $I_0$ and I ($\alpha=\{(I_0-I)/I_0\}\times100$) (step S703), and determines whether the thus calculated value of $\alpha$ is equal to or greater than the abnormal heating reference value stored in the normal current value storage 606 (step S704).

If the value of a is equal to or greater than the abnormal heating reference value (step S704: YES), the controller 60 determines that abnormal heating has occurred in the resistive heating layer 513 and thus stops the power feed to the power source 1000 of the fixing device 5 and displays a warning message indicating occurrence of the abnormal heating on the liquid crystal display of the operation panel 8 based on the data stored in the warning message storage 607 (step S705).

On the other hand, if the value of $\alpha$ is less than the abnormal heating reference value (step S704: NO) and the requested print job is not finished yet (there is a print job yet to be executed: step S706: NO), the controller moves onto step S702.

Figure 8:
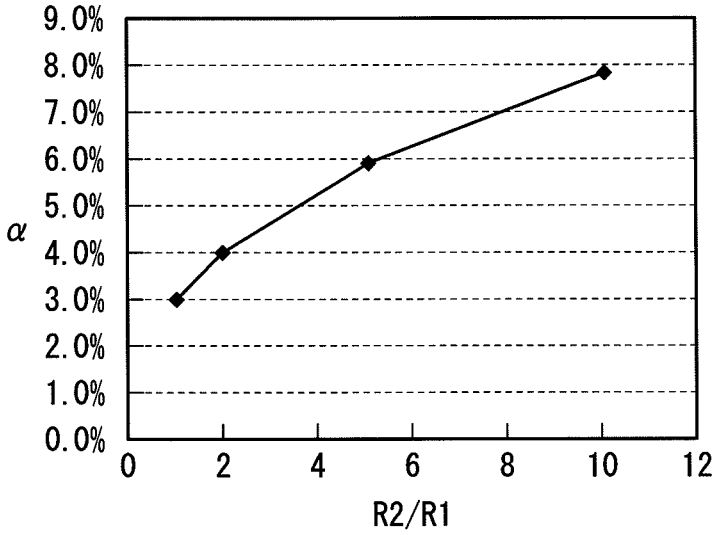
FIG. 8 is a graph showing results of experiments conducted to analyze the relation between $\alpha$ and R2/R1.
Figure 9:
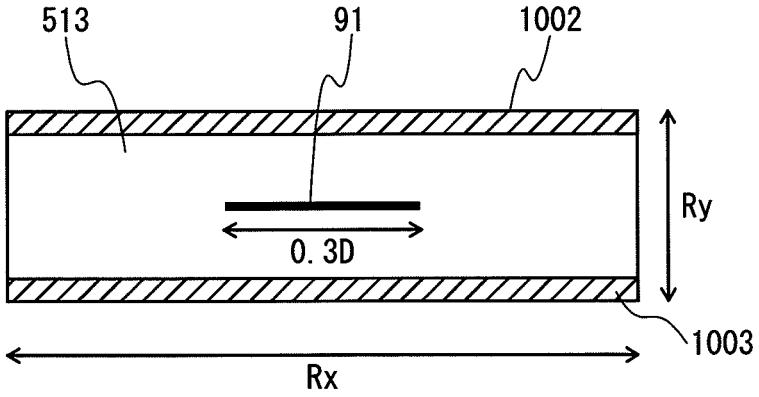
FIG. 9 is a schematic view of the resistive heating layer and power feed rollers and is presented to give supplemental explanation of the conditions for the experiments shown in FIG. 8.

[6] Relation between a and Electrical Resistance Ratio between Rx Direction and Ry Direction In the abnormal heating detection shown in FIGS. 6 and 7, the determination as to whether abnormal heating has occurred is made based on the amount of change a from the normal current value. Note that the value of a varies according the ratio R2/R1, where R1 denotes the volume resistivity of the resistive heating layer 513 in the direction of Ry, and R2 denotes the volume resistivity of the resistive heating layer 513 in the direction of Rx. FIG. 8 is a graph showing results of experiments conducted to analyze the relation between a and R2/R1. As shown in FIG. 9, the experiments were conducted by preparing sample resistive heating layers with different R2/R1 ratios and causing a scratch 91 running in the Rx direction at a location centrally of each resistive heating layer in the circumferential direction. Note that the length of the scratch 91 accounts for 0.3D, when the longitudinal length of the resistive heating layer is taken as D. Each sample resistive heating layer was then formed into a rotatable heating element to measure the current value flowing through the sample resistive heating layer upon completion of the warm-up time. Then, the value of a for each sample was calculated based on the measurements. In the figure, the reference signs 1002 and 1003 denote power feed rollers. The following were conditions set for the experiments. Each sample resistive heating layer formed into a rotatable heating element measured 340 mm in longitudinal length and 90 mm in the entire peripheral length. In addition, a scratch formed on each sample resistive heating layer measured 102 mm in longitudinal length. The voltage applied to each sample resistive heating layer was 100 V. The electrical resistance between the respective power feed rollers of each sample resistive heating layer was 9.5 Ω.

As indicated by the experimental results shown in FIG. 8, in the presence of a scratch in the resistive heating layer, the value of a increases as the ratio R2/R1 increases. The influence of measurement errors associated with a current detection circuit connected to the ammeter is greater for smaller value of $\alpha$. It is therefore difficult to accurately detect occurrence of abnormal heating in the resistive heating layer. The extent of measurement errors associated with the current detection circuit differs depending on various parameters, including the ammeter used. Yet, the ratio of R2/R1 of the resistive heating layer 513 is determined based on the experimental results shown in FIG. 8 in a manner to ensure that the value of $\alpha$ obtained in the presence of a scratch becomes significantly larger than the extent of measurement errors.

For example, the range of measurement errors associated with the current detection circuit (the current detection circuit connected to the ammeter 1001) used in the experiments is 3%. Therefore, in order to ensure the value of a measured at the time of abnormal heating to be significantly larger than fluctuations resulting from measurement errors, the ratio of R2/R1 needs to be at least equal to 4 or greater. As such, the resistive heating layer 513 needs to be adjusted with respect to the volume resistivity in the voltage application direction and that in the direction perpendicular to voltage application direction to achieve such a ratio.

By adjusting the volume resistivity of the resistive heating layer 513 in the voltage application direction and that in the direction perpendicular to the voltage application direction to make the ratio R2/R1 equal to 4 or greater, the value of a obtained at the time of abnormal heating is ensured to exceed 5%, which is larger than range of measurement errors (3%) associated with the current detection circuit used in the experiments. As a consequence, occurrence of abnormal heating is detected with accuracy through the process shown in FIG. 6 or 7.

As described above, in accordance with the extent of measurement errors associated with the current detection circuit, the resistive heating layer is adjusted to have an appropriate ratio between the volume resistivity in the voltage application direction and that in the direction perpendicular to the voltage application direction. This arrangement ensures that, occurrence of abnormal heating in the resistive heating layer is accurately detected using the current detection circuit without being influenced by the associated measurement errors. That is, the present embodiment enables a detection of abnormal heating occurring in a resistive heating layer only by measuring changes in the electric current flowing through the resistive heating layer, although such detection has been conventionally difficult due to influence of associated measurement errors.

MODIFICATIONS

Up to this point, the present invention has been described by way of the above embodiment. However, it should be naturally appreciated that the present invention is not limited to the specific embodiment and various modifications including the following may be made.

Figure 10:
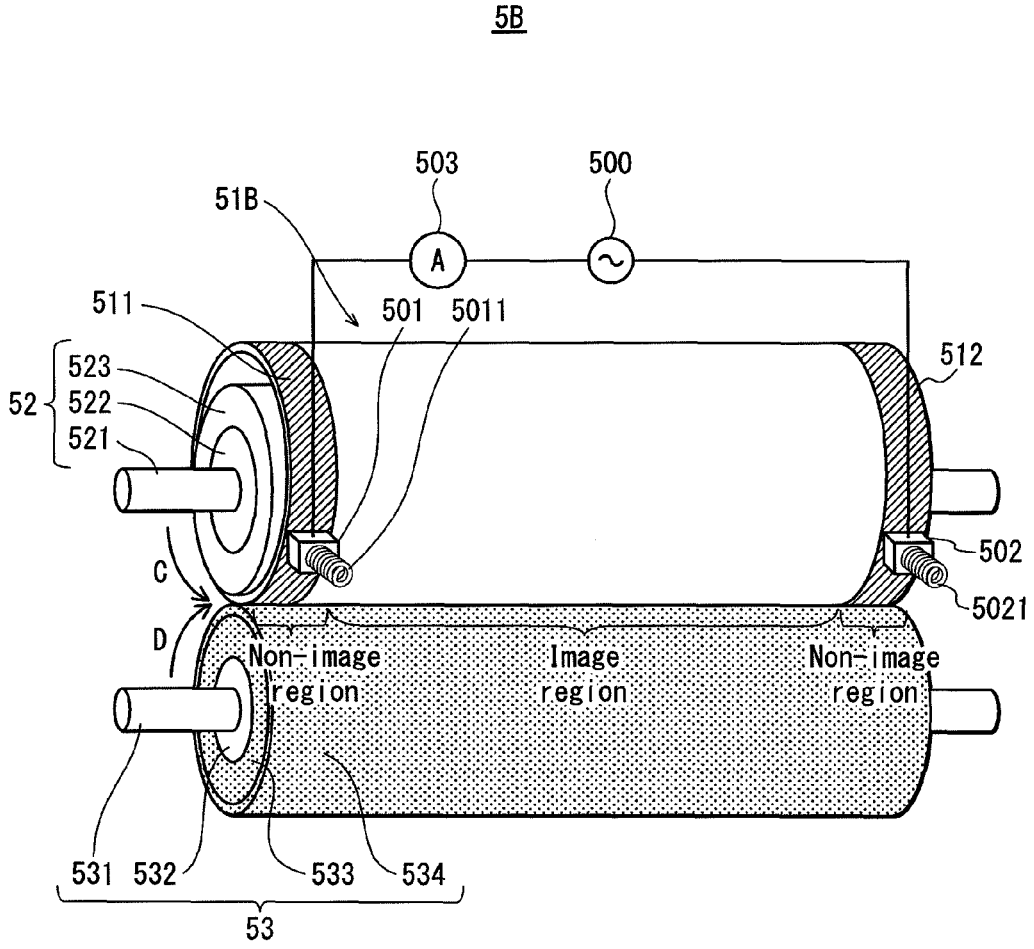
FIG. 10 is an oblique view showing a rotatable heating element according to a modification of the embedment.

(1) In the above embodiment, the voltage is applied to the resistive heating layer 513 of the rotatable heating element 51 in the circumferential direction thereof, so that the electric current flows through the resistive heating layer 513 in the circumferential direction. Alternatively, however, the voltage may be applied in the longitudinal direction of the rotatable heating element, so that the electric current flows through the resistive heating layer in the longitudinal direction. For example, an alternative fixing device may have a structure as shown in an oblique view in FIG. 10.

As shown in the figure, the alternative fixing device 5B includes a rotatable heating element 51B, a fixing roller 52, a pressing roller 53, a power source 500 for passing current by applying voltage across the ends of the rotatable heating element 51B (more precisely, a resistive heating layer 513B, which will be described later), an ammeter 503 for measuring the value of the electric current flowing through the rotatable heating element 51B (more precisely, the resistive heating layer 513B), and a pair of power feeders 501 and 502 for feeding current to the rotatable heating element 51B (more precisely, electrodes 511 and 512, which will be described later).

The rotatable heating element 51B is an endless belt and the electrodes 511 and 512 are disposed one along each edge of the endless belt. The power source 500 applies voltage across the electrodes 511 and 512 via the power feeders 501 and 502 to feed power. As the power feeders, power feed brushes or power feed rollers are usable, for example. In response to power fed from the power feeders, current flows between the electrodes so that the rotatable heating element 51B generates heat by Joule heating.

In addition, a non-illustrated temperature sensor is disposed at a predetermined location near the outer circumferential surface of the rotatable heating element 51B (in this example, at a location near the central portion in the lengthwise direction). The temperature sensor measures the temperature of the outer circumferential surface of the rotatable heating element 51B. Depending on the temperature measured by the temperature sensor, the controller 60 controls the power supply from the power source 500 to the rotatable heating element 51B so as to regulate the temperature of the outer circumferential surface of the rotatable heating element 51B to an appropriate fixing temperature (150° C., for example).

Figure 11:
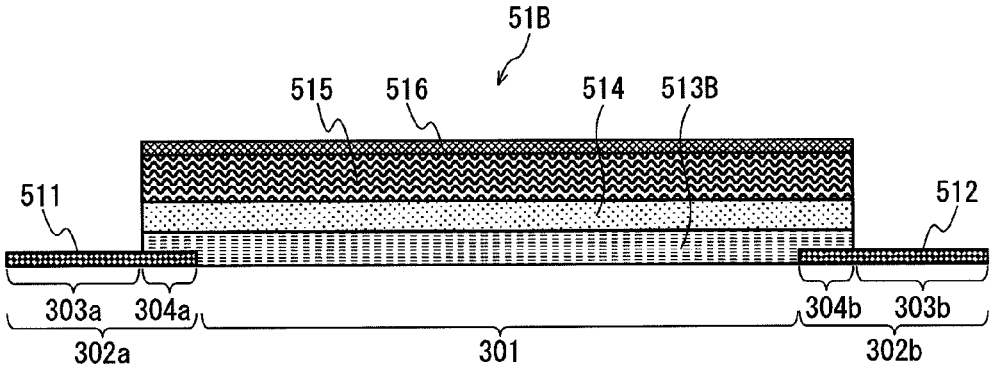
FIG. 11 is a cross sectional view showing the detailed structure of a rotatable heating element 51B.

FIG. 11 is a cross sectional view showing the detailed structure of the rotatable heating element 51B. The rotatable heating element 51B has an image region 301, As shown in the figure, part of the rotatable heating element 51B in the image region 301 is similar to the above-described embodiment in that it includes a resistive heating layer 513, a reinforcing layer 514, an elastic layer 515, and a releasing layer 516 that are laminated in the stated order. Note that the components identical to those of the rotatable heating element 51 are denoted by the same reference signs and not a description thereof is omitted.

Note the "image region 301" refers to a circumferential region of the rotatable heating element 51 and corresponds, in the belt width direction, to where recording sheets are conveyed. The same definition holds with respect to the image region shown in FIG. 10.

The resistive heating layer 513B generates heat by Joule heating upon power feed from the power source 500 via the electrodes 511 and 512. The resistive heating layer 513B is made from a heat-resistant resin and fibrous, acicular, or flaked conductive filler particles that are dispersed on or in the heat-resistant resin so that the filler particles are oriented in the longitudinal direction (i.e., voltage application direction).

Figure 12A:
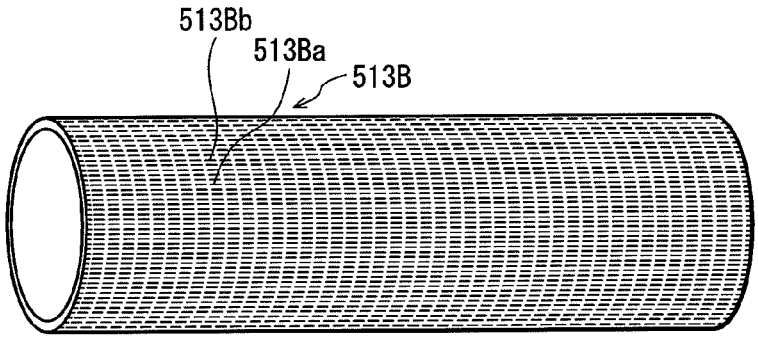
FIG. 12A is a view conceptually showing the minute structure of a resistive heating layer 513B.
Figure 12B:
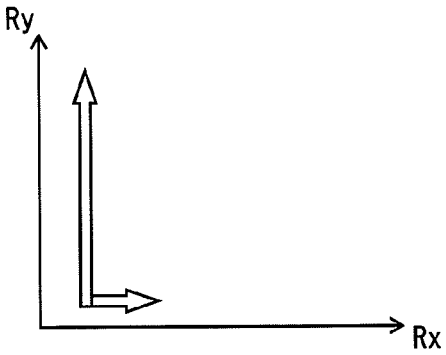
FIG. 12B is a plot conceptually showing resistivity anisotropy of the resistive heating layer 513B.

FIGS. 12A and 12B are views each conceptually showing the minute structure of a resistive heating layer 513B. In FIG. 12A, the reference sign 513B denotes the resistive heating layer, 513Ba denotes the conductive filler particles, and 513Bb denotes the heat-resistant resin. As shown in the figure, the conductive filler particles 513Ba are disposed to have an orientation in the lengthwise direction (voltage application direction) of the resistive heating layer 513B. With this arrangement, the conductivity of the resistive heating layer 513B is made higher in the voltage application direction than in the circumferential direction (the direction perpendicular to the voltage application direction). Consequently, the resistive heating layer 513B exhibits resistivity anisotropy in which the electrical resistance (volume resistivity) measured in the voltage application direction (direction of Rx) differs from that measured in the direction perpendicular to the voltage application direction (direction of Ry) as represented by the length of each white arrow in FIG. 12B. More specifically, the electrical resistance (volume resistivity) of the resistive heating layer 513B is larger in the Ry direction (i.e., the direction perpendicular to the voltage application direction) than in the Rx direction (i.e., the voltage application direction).

The rotatable heating element 51B has non-image regions along the edges and denoted by reference signs 302*a* and 302*b* in FIG. 11. Each of the non-image regions 302*a* and 302*b* is composed of an exposed region 303*a* or 303*b* and an overlapping region 304*a* or 304*b*.

Note the "non-image regions 302*a* and 302*b*" each refers to a circumferential region of the rotatable heating element 51B and corresponds, in the belt width direction, to where recording sheets are not conveyed. The same definition holds with respect to the non-image regions shown in FIG. 10.

In each of the exposed regions 303*a* and 303*b*, a corresponding one of the electrodes 511 and 512 is the only layer and thus exposed. In each of the overlapping regions 304*a* and 304*b*, the resistive heating layer 513B extends to partially overlap with both the electrodes 511 and 512, so that the electrodes 511 and 512 are covered by the resistive heating layer 513B and not exposed. In addition, the reinforcing layer 514, the elastic layer 515, and the releasing layer 516 are layered on the resistive heating layer 513B in the stated order.

The electrodes 511 and 512 are made from a conductive material. Examples of the electrode material include metals, such as copper (Cu), aluminum (Al), nickel (Ni), stainless (SUS), brass, phosphor bronze. Preferably, the use of an electrode material having low volume resistivity as well as excellent resistance to heat and oxidation is preferable, such as nickel, stainless, and aluminum. As for the thickness, a thicker electrode offers greater rigidity and is more resistant to breakage but at a cost of a greater risk of deformation in the fixing nip formed by pressing components. In view of the balance with flexibility, the electrode thickness preferably falls within the range of 10 to 100 μm, and more preferably within the range of 30 to 70 μm.

Referring back to FIG. 10, the power feeders 501 and 502 are each provided with a biasing member 5011 or 5021 for biasing the power feeder against the rotatable heating element 51 in the direction inwardly of the running path. Compression springs are one example of the biasing members. By the biasing force imparted by the biasing members 5011 and 5021, the power feeders are pressed against the electrodes exposed at the exposed regions.

The fixing roller 52 has a cored bar 522 that is rotatably mounted at both ends 521 on a pair of bearings (not illustrated) secured on a non-illustrated frame. Similarly, the pressing roller 53 has a cored bar 532 that is rotatably mounted at both ends 531 on a pair of bearings (not illustrated) on the non-illustrated frame. The pressing roller 53 is driven to rotate in the direction indicated by the arrow D upon receipt of power from a drive motor (not illustrated). Along with the rotation of the pressing roller 53, the rotatable heating element 51B and the fixing roller 52 passively rotate in the direction of arrow C.

The fixing roller 52 is composed of an elongated cylindrical cored bar 522 and a heat insulating layer 523 formed around the cored bar 522. The fixing roller 52 is disposed inside the running path of the rotatable heating element 51B and having an axial length longer than the axial distance between where the power feeders disposed to press the electrodes 511 and 512 at the exposed regions of the rotatable heating element 51B. The cored bar 522 supports the fixing roller 52 and is composed of a material having heat resistance and strength. Examples of the material for the cored bar 522 include aluminum, iron, and stainless.

The heat insulating layer 523 prevents heat generated by the rotatable heating element 51B from escaping to the cored bar 522. Preferable examples of the material for the heat insulating layer 523 include a sponge (thermal insulator) made from rubber or resin having low thermal conductivity along with heat resistance and elasticity. It is because the heat insulating layer 523 made from such a material accommodates corrugations of the rotatable heating element 851 to ensure the nip to have a sufficient length. The heat insulating layer 523 may be of a dual layer structure of a solid layer and a sponge layer. In the case where a silicon sponge material is used as the heat insulating layer 523, it is preferable to make the thickness fall within the range of 1 to 10 mm. More preferably, the thickness falls within the range of 2 to 7 mm.

The pressing roller 53 is composed of the cylindrical cored bar 532 and an elastic layer 533 and a releasing layer 534 that are laminated around the cored bar 532 in the stated order. The pressing roller 53 is located outside the running path of the rotatable heating element 51B to press the outer circumferential surface of the rotatable heating element 51B inwardly toward the fixing roller 52. As a result, a fixing nip having a predetermined length in the circumferential direction is formed between the pressing roller 53 and the rotatable heating element 51B.

The cored bar 532A supports the pressing roller 53 and is composed of a material having heat resistance and strength. Examples of the material for the cored bar 532 include aluminum, iron, and stainless. The elastic layer 533 is an elastic body such as silicone rubber or fluorine-containing rubber and formed of a heat-resistant material to have a thickness falling in the range of 1 to 20 mm. Similarly to the releasing layer 516, the releasing layer 534 improves the properties of ensuring a recording sheet to be released easily from the pressing roller 53. The releasing layer 534 may be identical to the releasing layer 516 in terms of its material and thickness. The rotatable heating element 51B is formed through the following processes (a) to (k).

(a) Process of Forming Electrodes 511 and 512

Metal material for forming electrodes (such as nickel, stainless, or aluminum) is processed into ring-shaped electrodes having a thickness from 30 to 70 μm (electrodes 511 and 512). The processing method may be electroforming, spinning, drawing, or the like. In addition, the ring-shaped electrodes may be made from metal sheet for forming electrodes, by laser welding.

(b) Process of Attaching Electrodes 511 and 512 to Cylindrical Metal Mold After applying a releasing agent on the surface of a cylindrical metal mold to improve the mold releasing properties, the ring-shaped electrode 511 and 512 formed in the process (a) are fitted over the cylindrical metal mold at a predetermined spaced relation in the axial direction. In this way, the electrodes 511 and 512 are attached to the cylindrical metal mold.

(c) Process of Applying Precursor of Resistive Heating Layer 513B

Conductive filler is mixed into a polyimide precursor solution to prepare the polyimide precursor solution in which the conductive filler particles are dispersed. After masking the regions of the electrodes 511 and 512 to be later become the exposed regions, the thus prepared precursor solution is applied to the outer circumferential surface of the cylindrical metal mold through a nozzle. The application of the precursor solution is done by moving the nozzle in the axial direction of the cylindrical metal mold while rotating the cylindrical metal mold. More specifically, the nozzle is scanned in the axial direction of the cylindrical metal mold to disperse conductive filler particles oriented in axial alignment. Then, the cylindrical metal mold is rotated for a predetermined angle to carry out another scan in the axial direction. This scanning and rotating is repeated until the cylindrical metal mold is rotated for one full turn.

After the application process, the applied polyimide precursor solution is brought into a semi-cured state. The polyimide precursor solution is brought into a semi-cured state by, for example, heating the metal mold in an oven at about 100° C. for about an hour.

The conductive filler dispersed in the polyimide precursor solution is adjusted to constitute 50% to 300% by weight of the solids contents of the polyimide precursor in the solution. With the above arrangement, the volume resistivity of the resistive heating layer 513B is adjusted to cause the amount of heat generated by the fixing device 5B to fall in the range of 500 to 1500 W.

In addition, by adjusting the density of the conductive filler particles applied in the axial direction of the cylindrical metal mold or the angle by which the cylindrical metal mold is rotated at a time, the resistive heating layer 513B is ensured to have a desired ratio of the volume resistivity between the axial direction of the cylinder (i.e., the voltage application direction) and the direction perpendicular to the axial direction of the cylinder.

For example, the resistive heating layer 513B having a desired ratio of the volume resistivity is obtained by adjusting various parameters, including the nozzle diameter, nozzle scanning speed, discharging amount of the nozzle, the rotation speed of the cylindrical metal mold, and the viscosity of the polyimide precursor solution in which conductive filler particles are dispersed.

Of the processes of manufacturing the resistive heating layer 513B according to this modification, the following processes are basically the same as the corresponding processes for manufacturing the resistive heating layer 513 according to the above embodiment: (d) process of applying precursor of the reinforcing layer 514; (e) process of forming the reinforcing layer 514; (f) process of polyimide precursor imidization; (g) process of applying precursor of the elastic layer 515; (h) process of forming the elastic layer 515; (i) process of coating the elastic layer 515 with the releasing layer 516; and (j) process of bonding.

(k) Process of Removing Mask

The mask provided for the electrodes 511 and 512 fitted over the cylindrical metal mold are removed and the rotatable heating element 51B formed around the cylindrical metal mold is released from the metal mold.

Figure 13:
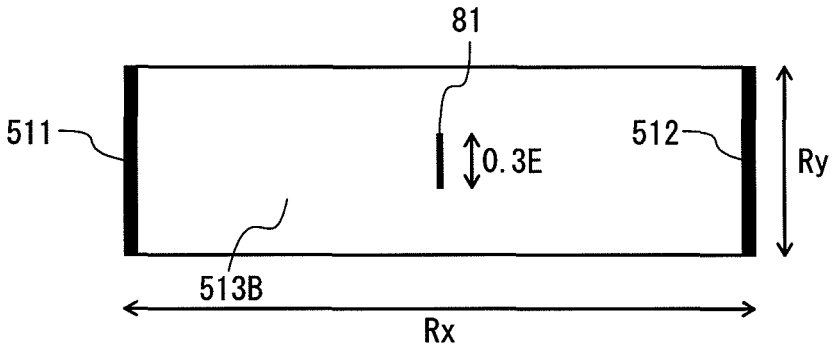
FIG. 13 is a schematic view showing the resistive heating layer and electrodes and is presented to give supplemental explanation of the conditions for the experiments conducted to analyze the resistive heating layer 513B for the relation between $\alpha$ and the ratio R2'/R1', where R1' represents the volume resistivity in the voltage application direction and R2' represents the volume resistivity in the direction perpendicular to the voltage application direction.

Experiments were conducted on the resistive heating layer 513B according to this modification to analyze the relation between a and the ratio R2'/R1', where R1' represents the volume resistivity in the voltage application direction, and R2' represents the volume resistivity in the direction perpendicular to the voltage application direction. The experimental results were similar to those obtained from the experiments conducted on the resistive heating layer 513 according to the embodiment (see FIG. 8). As shown in FIG. 13, the experiments in this modification were conducted by preparing sample resistive heating layers with different R2'/R1' ratios and causing a scratch 81 running in the Ry direction at a location centrally of each resistive heating layer in the longitudinal direction. Note that the length of the scratch 81 accounts for 0.3E, when the entire circumferential length of the resistive heating layer is taken as E. Each sample resistive heating layer was then formed into a rotatable heating element to measure the current value flowing through the sample resistive heating layer upon completion of the warm-up time. Then, the value of a for each sample was calculated based on the measurements. In the figure, the reference signs 511 and 512 denote the electrodes. The following were conditions set for the experiments. Each sample resistive heating layer formed into a rotatable heating element measured 340 mm in longitudinal length and 90 mm in the entire peripheral length. In addition, a scratch formed on each sample resistive heating layer measured 27 mm in the circumferential direction. The voltage applied to each sample resistive heating layer was 100 V. The electrical resistance between the respective power feed rollers of each sample resistive heating layer was 9.5 Ω.

Figure 14:
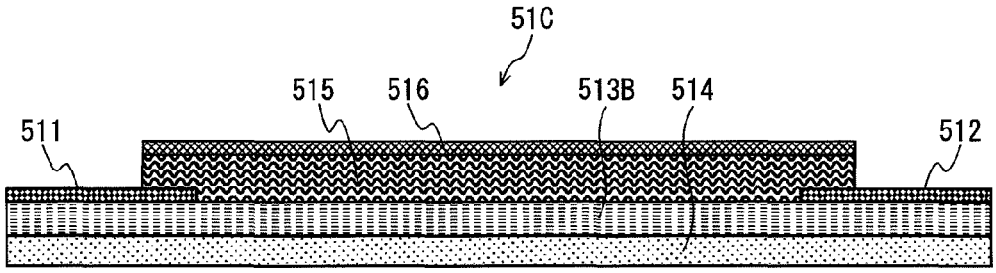
FIG. 14 is an oblique view showing a rotatable heating element according to another modification of the embedment.

(2) According to the modification described in (1) above, the rotatable heating element 51B has the reinforcing layer 514 layered on the resistive heating layer 513 and part of the electrodes 511 and 512 are exposed as the single layer constituting the exposed regions of the rotatable heating element 51B. However, the structure of the rotatable heating element is not limited to such and other structures including the following are applicable. For example, the rotatable heating element may have a structure shown in FIG. 14. As shown in the figure, a rotatable heating element 51C is composed of identical components as those of the rotatable heating element 51B and bears the same reference signs. As shown in the figure, however, rotatable heating element 51C differs from the rotatable heating element 51B in that the resistive heating layer 513B is layered on the reinforcing layer 514 and that the electrodes 511 and 512 are formed on the resistive heating layer 513B.

<Recapitulation>

As has been disclosed above, according to one aspect of the present invention, a fixing device for thermally fixing an unfixed toner image onto a recording sheet includes: a heating belt that is endless and includes a resistive heating layer configured to generate heat to fuse the unfixed image on the recording sheet; an electrifier that applies voltage across the resistive heating layer; a detector that measures a value of electric current flowing through the resistive heating layer; and a determiner that determines whether or not the resistive heating layer has a scratch by monitoring an amount of change between a reference value predetermined for an electric current flowing through the resistive heating layer having no scratch and an actual value of the electric current measured by the detector. The resistive heating layer exhibits resistivity anisotropy satisfying R1<R2, where R1 denotes a volume resistivity of the resistive heating layer in a direction of voltage application, and R2 denotes a volume resistivity of the resistive heating layer in a direction perpendicular to the direction of voltage application.

According to another aspect of the present invention, an image forming apparatus includes: a fixing device configured to thermally fix an unfixed image on a recording sheet. The fixing device includes: a heating belt that is endless and includes a resistive heating layer configured to generate heat to fuse the unfixed image on the recording sheet; an electrifier that applies voltage across the resistive heating layer; a detector that measures a value of electric current flowing through the resistive heating layer; and a determiner that determines whether or not the resistive heating layer has a scratch by monitoring an amount of change between a reference value predetermined for an electric current flowing through the resistive heating layer having no scratch and an actual value of the electric current measured by the detector. The resistive heating layer exhibits resistivity anisotropy satisfying R1<R2, where R1 denotes a volume resistivity of the resistive heating layer in a direction of voltage application, and R2 denotes a volume resistivity of the resistive heating layer in a direction perpendicular to the direction of voltage application.

According to a yet another aspect of the present invention, a scratch detection method is for use with a fixing device that thermally fixes an unfixed image on a recording sheet and that includes a heating belt including a resistive heating layer configured to generate heat upon being electrified. The scratch detection method includes: an electrifying step of applying voltage across the resistive heating layer; a detecting step of measuring a value of electric current flowing through the resistive heating layer; a determining step of determining whether or not the resistive heating layer has a scratch, by monitoring an amount of change between a reference value predetermined for an electric current flowing through the resistive heating layer having no scratch and an actual value of the electric current measured in the detecting step. The resistive heating layer exhibits resistivity anisotropy satisfying R1<R2, where R1 denotes a volume resistivity of the resistive heating layer in a direction of voltage application, and R2 denotes a volume resistivity of the resistive heating layer in a direction perpendicular to the direction of voltage application.

Optionally, the resistive heating layer may be configured so that an amount of change between the reference value and a value of electric current flowing in presence of a scratch extending perpendicular to the direction of the voltage application exceeds a lower limit for the determiner to make the determination.

Optionally, the resistive heating layer may include: a heat-resistant resin; and conductive filler particles dispersed in the heat-resistant resin so as to be oriented in the direction of the voltage application. Optionally, the heating belt may include a pair of electrodes that are disposed along edges opposite in a longitudinal direction and feed power to the resistive heating layer. The electrifier may applies voltage in the longitudinal direction via the electrodes.

Optionally, each electrode may be disposed throughout an entire circumference of the heating belt. Optionally, the electrifier may apply voltage in a circumferential direction of the heating belt. Optionally, the resistive heating layer is configured to exhibit a value of R2/R1 equal to 4 or greater.

With the configurations sated above, the resistive heating layer exhibits resistivity anisotropy in which the volume resistivity R1 in the direction of voltage application (hereinafter, simply voltage application direction) is not greater than the volume resistivity R2 in the direction perpendicular to the voltage application direction, so that a greater change is observed between the value of electric current measured when a flaw occurs in the direction perpendicular to the voltage application direction and the value of electric current measured when no flaw has occurred is greater than that observed with a resistive heating layer without resistivity anisotropy.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for thermally fixing an unfixed toner image onto a recording sheet, the fixing device comprising:

a heating belt that is endless and includes a resistive heating layer configured to generate heat to fuse the unfixed toner image onto the recording sheet;

an electrifier that applies voltage across the resistive heating layer in a circumferential direction of the heating belt, to heat the resistive heating layer;

a detector that measures a value of electric current flowing through the resistive heating layer along the direction of voltage application for heating the resistive heating layer; and a determiner that determines whether or not the resistive heating layer has a scratch by monitoring an amount of change between a reference value predetermined for an electric current flowing through the resistive heating layer having no scratch and an actual value of the electric current measured by the detector, wherein the resistive heating layer exhibits resistivity anisotropy satisfying R1<R2, where R1 denotes a volume resistivity of the resistive heating layer in the direction of voltage application, and R2 denotes a volume resistivity of the resistive heating layer in a direction perpendicular to the direction of voltage application.

2. The fixing device according to claim 1, wherein the resistive heating layer is configured so that an amount of change between the reference value and a value of electric current flowing in presence of a scratch extending perpendicular to the direction of the voltage application exceeds a lower limit for the determiner to make the determination.

3. The fixing device according to claim 1, wherein the resistive heating layer includes:

a heat-resistant resin; and conductive filler particles dispersed in the heat-resistant resin so as to be oriented in the direction of the voltage application.

4. The fixing device according to claim 1, wherein the resistive heating layer is configured to exhibit a value of R2/R1 equal to 4 or greater.

5. An image forming apparatus comprising:

a fixing device configured to thermally fix an unfixed image on a recording sheet, wherein the fixing device includes:

a heating belt that is endless and includes a resistive heating layer configured to generate heat to fuse the unfixed image on the recording sheet;

an electrifier that applies voltage across the resistive heating layer in a circumferential direction of the heating belt, to heat the resistive heating layer;

a detector that measures a value of electric current flowing through the resistive heating layer along the direction of voltage application for heating the resistive heating layer; and a determiner that determines whether or not the resistive heating layer has a scratch by monitoring an amount of change between a reference value predetermined for an electric current flowing through the resistive heating layer having no scratch and an actual value of the electric current measured by the detector, wherein the resistive heating layer exhibits resistivity anisotropy satisfying R1<R2, where R1 denotes a volume resistivity of the resistive heating layer in the direction of voltage application, and R2 denotes a volume resistivity of the resistive heating layer in a direction perpendicular to the direction of voltage application.

6. The image forming apparatus according to claim 5, wherein the resistive heating layer is configured so that an amount of change between the reference value and a value of electric current flowing in presence of a scratch extending perpendicular to the direction of the voltage application exceeds a lower limit for the determiner to make the determination.

7. The image forming apparatus according to claim 5, wherein the resistive heating layer includes:

a heat-resistant resin; and conductive filler particles dispersed in the heat-resistant resin so as to be oriented in the direction of the voltage application.

8. The image forming apparatus according to claim 5, wherein the resistive heating layer is configured to exhibit a value of R2/R1 equal to 4 or greater.

9. A scratch detection method of a fixing device that thermally fixes an unfixed image on a recording sheet and that includes a heating belt including a resistive heating layer configured to generate heat upon being electrified, the scratch detection method comprising:

applying voltage across the resistive heating layer in a circumferential direction of the heating belt, to heat the resistive heating layer;

measuring a value of electric current flowing through the resistive heating layer along the direction of voltage application for heating the resistive heating layer;

determining whether or not the resistive heating layer has a scratch, by monitoring an amount of change between a reference value predetermined for an electric current flowing through the resistive heating layer having no scratch and an actual value of the measured electric current;

wherein the resistive heating layer exhibits resistivity anisotropy satisfying R1<R2, where R1 denotes a volume resistivity of the resistive heating layer in the direction of voltage application, and R2 denotes a volume resistivity of the resistive heating layer in a direction perpendicular to the direction of voltage application.

10. The scratch detection method according to claim 9, wherein the resistive heating layer is configured so that an amount of change between the reference value and a value of electric current flowing in presence of a scratch extending perpendicular to the direction of the voltage application exceeds a lower limit for the determiner to make the determination.

* * * * *